US007441756B2

(12) United States Patent
Niedermann et al.

(10) Patent No.: US 7,441,756 B2
(45) Date of Patent: Oct. 28, 2008

(54) HUMIDIFIER WITH ADORNMENT TO SIMULATE THE APPEARANCE OF A THREE DIMENSIONAL OBJECT

(75) Inventors: Dirk Niedermann, Bloomingdale, IL (US); Chen Hui, Guangdong (CN)

(73) Assignee: Wachsmuth and Krogmann, Inc., Bensenville, IL (US)

( * ) Notice: Subject to any disclaimer, the term of this patent is extended or adjusted under 35 U.S.C. 154(b) by 0 days.

(21) Appl. No.: 11/244,207

(22) Filed: Oct. 5, 2005

(65) Prior Publication Data

US 2007/0075448 A1 Apr. 5, 2007

(51) Int. Cl.
*B01F 3/04* (2006.01)

(52) U.S. Cl. ..... 261/119.1; 261/DIG. 65

(58) Field of Classification Search ..... 261/72.1, 261/119.1, DIG. 65; 239/34, 51.5; D23/360
See application file for complete search history.

(56) References Cited

U.S. PATENT DOCUMENTS

| | | | | | |
|---|---|---|---|---|---|
| 544,175 | A | * | 8/1895 | Iliowski | 261/119.1 |
| 1,313,832 | A | * | 8/1919 | Patterson | 239/51.5 |
| 1,534,624 | A | * | 4/1925 | Weidlich | 422/125 |
| D71,998 | S | | 2/1927 | Brandon | |
| 2,802,090 | A | | 8/1957 | Katzman et al. | |
| D240,828 | S | | 8/1976 | Manfredi | |
| 4,958,768 | A | * | 9/1990 | Ishihara | 239/34 |
| 4,993,411 | A | * | 2/1991 | Callaway | 128/204.14 |
| 5,061,405 | A | * | 10/1991 | Stanek et al. | 261/26 |
| D335,340 | S | | 5/1993 | Marvin, Jr. | |
| 5,233,680 | A | * | 8/1993 | Fussell | 392/390 |
| 5,299,736 | A | * | 4/1994 | Greene | 239/56 |
| D353,663 | S | | 12/1994 | Curren | |
| D369,209 | S | | 4/1996 | Chiang | |
| 5,567,361 | A | * | 10/1996 | Harper | 261/26 |
| 5,672,299 | A | | 9/1997 | Daneshvar | |
| 5,690,096 | A | | 11/1997 | Burch | |
| 5,853,002 | A | | 12/1998 | Kawasaki | |
| 6,019,355 | A | * | 2/2000 | Birdsell et al. | 261/66 |
| 6,588,420 | B1 | | 7/2003 | Burch | |
| D496,719 | S | | 9/2004 | Song | |
| 7,032,831 | B2 | * | 4/2006 | Duston et al. | 239/44 |
| 2004/0084787 | A1 | * | 5/2004 | Williams et al. | 261/72.1 |
| 2005/0194460 | A1 | * | 9/2005 | Selander | 239/34 |

* cited by examiner

*Primary Examiner*—Scott Bushey
(74) *Attorney, Agent, or Firm*—Wood, Phillips, Katz, Clark & Mortimer

(57) ABSTRACT

An apparatus for directing a vaporized substance into a space. The apparatus has a base with operating components capable of converting a liquid substance into a vapor, and a substance supply container that is separable from the base. The substance supply container in an operative state in relationship to the base delivers a supply of a substance therein in liquid form to the operating components on the base to be vaporized thereby. Vapor generated by the operating components is directed into a space within which the apparatus is located. The base and substance supply container cooperatively simulate the appearance of at least one of an animate or inanimate object.

32 Claims, 10 Drawing Sheets

HUMIDIFIER WITH ADORNMENT TO SIMULATE THE APPEARANCE OF A THREE DIMENSIONAL OBJECT

BACKGROUND OF THE INVENTION

1. Field of the Invention

This invention relates to humidifiers and, more particularly, to a humidifier that is adorned to simulate the appearance of a three dimensional object so as to make the humidifier an attractive addition to a space within which it is utilized.

2. Background Art

Portable humidifiers are used in many homes and businesses to increase the moisture content of air that otherwise may be unacceptably dry. The air in a particular space may be humidified to address a particular physical condition of an occupant, or to optimize conditions within a space to promote comfortable breathing, avoid drying of skin, etc. The degree of moisture content in a space is generally a personal preference. "Central" humidification may be carried out to a predetermined level that is not detrimental to a person sensitive to high humidity air. Those that prefer a higher level of humidity generally satisfy this desire by infusing water vapor into the surrounding space, as by using a portable humidifier unit.

Many different types of portable humidifiers are currently offered in the marketplace, with myriad different shapes available. What is common to these units is that they have a container for a supply of water, which is caused to be vaporized and released into the surrounding space. The outline of these portable units may be generally squared or rounded, with transverse footprint and height dimensions generally on the order of one to two feet.

Humidifiers are commonly used in children's rooms, particularly in winter months, to promote comfortable breathing. Central, forced air heating systems generally introduce relatively dry air into a space. This dry air may impair breathing in young children, both with and without medical conditions.

Generally, portable humidifiers are designed primarily with function, rather than aesthetics, in mind. Thus, most commercially available units are quite basic in appearance, without any adornment that causes them to contribute to, or blend with, a particular decor. Particularly in young children's rooms, unadorned portable humidifiers may clash noticeably with a particular decorating theme that predominates. The unattractiveness of many current designs may cause parents and children to forego use of a humidifier, even though atmospheric conditions within the space may dictate its desirability.

The industry continues to seek out functional humidifier designs that might be effectively aesthetically integrated with the furnishings in a particular space. Successful designs meeting these two criteria would encourage the use of humidifiers and increase their sales volume.

SUMMARY OF THE INVENTION

In one form, the invention is directed to an apparatus for directing a vaporized substance into a space. The apparatus has a base with operating components capable of converting a liquid substance into a vapor, and a substance supply container that is separable from the base. The substance supply container in an operative state in relationship to the base delivers a supply of a substance therein in liquid form to the operating components on the base to be vaporized thereby. Vapor generated by the operating components is directed into a space within which the apparatus is located. The base and substance supply container cooperatively simulate the appearance of at least one of an animate or inanimate object.

In one form, the base has a bottom that can be placed upon a support surface. With the substance supply container in the operative state, the substance supply container is situated on top of the base. The apparatus has a height. The majority of the height of the apparatus may be adorned to simulate the appearance of the at least one of an animate and inanimate object.

In one form, the substance supply container has a main body with a lifting handle that can be engaged by a user to lift the substance supply container and the substance supply container has an adornment piece that can be placed upon the main body to at least partially cover the lifting handle. The adornment piece simulates the appearance of a part of the at least one of an animate and inanimate object.

In one form, the adornment piece has an inverted cup shape that conforms to a part of the main body.

In one form, the adornment piece has an opening through which vapor generated by the operating components is controllably directed.

In one form, the base has bottom upon which adornment is provided that simulates feet of a living being and the substance supply container has adornment thereon that simulates the head of the living being.

In one form, the substance supply container has a main body and an adornment piece that can be placed removably upon the main body. The adornment piece simulates at least a part of the head of the living being.

In one form, the adornment piece has an opening through which vapor generated by the operating components is controllably directed to thereby give the appearance that vapor is emanating from the simulated head of the living being.

In one form, the substance supply container has a lifting handle that can be engaged by a user to lift the substance supply container, and the adornment piece can be selectively: a) separated from the main body to expose the lifting handle; and b) placed upon the main body to at least partially cover the lifting handle.

The invention is further directed to an apparatus for directing a vaporized substance into a space. The apparatus has a base with operating components capable of converting a liquid substance into a vapor, and a substance supply container that is separable from the base. The substance supply container in an operative state in relationship to the base delivers a supply of a substance therein in liquid form to the operating components on the base to be vaporized thereby. Vapor generated by the operating components is directed into a space within which the apparatus is located. The base has a bottom that can be placed upon a support surface. With the container in the operative state, the substance supply container is situated on top of the base. The apparatus has a height, with the majority of the height of the apparatus adorned to simulate the appearance of the at least one of an animate and inanimate object.

In one form, there is adornment on each of the base and substance supply container that simulates the appearance of at least a part of the at least one of an animate and inanimate object.

In one form the substance supply container has a main body with a lifting handle that can be engaged by a user to lift the substance supply container, and the substance supply container has an adornment piece that can be placed upon the main body to at least partially cover the lifting handle. The adornment piece simulates the appearance of a part of the at least one of an animate and inanimate object.

The adornment piece may have an inverted cup shape that conforms to a part of the main body.

In one form, the adornment piece has an opening through which vapor generated by the operating components is controllably directed.

In one form, adornment is provided on the bottom of the base that simulates feet of a living being and the substance supply container has adornment thereon that simulates the head of the living being.

In one form, the substance supply container has a main body and an adornment piece that can be placed removably upon the main body. The adornment piece simulates the appearance of at least a part of the head of the living being.

In one form, the adornment piece has an opening through which vapor generated by the operating components is controllably directed to thereby give the appearance that vapor is emanating from the simulated head of the living being.

In one form, the substance supply container has a lifting handle that can be engaged by a user to lift the substance supply container, and the adornment piece can be selectively: a) separated from the main body to expose the lifting handle; and b) placed upon the main body to at least partially cover the lifting handle.

The invention is further directed to an apparatus for directing a vaporized substance into a space. The apparatus has a base with operating components capable of converting a liquid substance into a vapor, and a substance supply container that is separable from the base. The substance supply container in an operative state in relationship to the base delivers a supply of a substance therein in liquid form to the operating components on the base to be vaporized thereby so that vapor generated by the operating components is directed into a space within which the apparatus is located. At least a part of the apparatus is adorned to simulate the appearance of at least one of an animate and inanimate object. The substance supply container has a main body with a lifting handle that can be engaged by a user to lift the substance supply container. The substance supply container has an adornment piece that can be placed upon the main body to at least partially cover the lifting handle. The adornment piece simulates the appearance of a part of the at least one an animate and inanimate object.

In one form, the base has a bottom that can be placed upon a support surface. With the substance supply container in the operative state, the substance supply container is situated on top of the base. The apparatus has a height, with the majority of the height of the apparatus adorned to simulate the appearance of the at least one of an animate and inanimate object.

In one form, the adornment piece has an inverted cup shape that conforms to a part of the main body.

The adornment piece may have an opening through which vapor generated by the operating components is controllably directed.

In one form, the base has a bottom upon which adornment is provided that simulates feet of a living being and the substance supply container has adornment thereon that simulates the head of the living being.

In one form, the substance supply container has a main body and an adornment piece that can be placed removably upon the main body. The adornment piece simulates the appearance of at least a part of the head of the living being.

In one form, the adornment piece has an opening through which vapor generated by the operating components is controllably directed to thereby give the appearance that vapor is emanating from the simulated head of the living being.

In one form, the substance supply container has a lifting handle that can be engaged by a user to lift the substance supply container, and the adornment piece can be selectively: a) separated from the main body to expose the lifting handle; and b) placed upon the main body to at least partially cover the lifting handle.

The invention is further directed to an apparatus for directing a vaporized substance into a space. The apparatus has a base with operating components capable of converting a liquid substance into a vapor, and a substance supply container. The substance supply container in an operative state in relationship to the base delivers a supply of a substance therein in liquid form to the operating components on the base to be vaporized thereby. The vapor generated by the operating components is directed into a space within which the apparatus is located. At least part of the apparatus is adorned to simulate the appearance of at least one of an animate or inanimate object. There is an adornment piece that simulates the appearance of at least a part of the animate or inanimate object. The adornment piece is capable of being selectively placed upon and separated from at least one of the base and substance supply container.

The apparatus may further have a lifting handle. The adornment piece can be selectively: a) separated from the main body to expose the lifting handle; and b) placed upon the main body to at least partially cover the lifting handle.

DETAILED DESCRIPTION OF THE DRAWINGS

Figure 1:
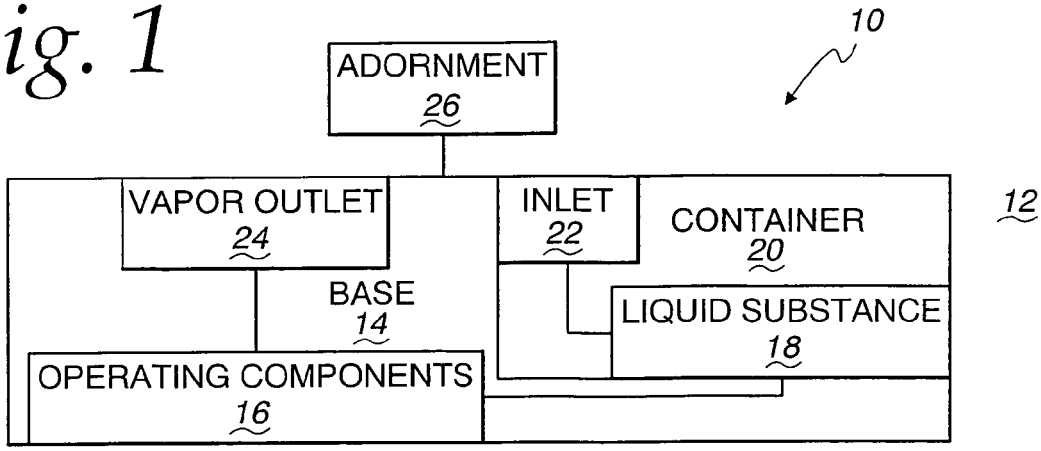
FIG. 1 is a schematic representation of one form of apparatus for directing a vaporized substance into a space, and adorned according to the present invention, and wherein a liquid substance container is integrated into a base having operating components for generating vapor.

In FIG. 1, an apparatus, according to the present invention, is shown schematically at 10, for directing a vaporized substance into a surrounding space 12. The apparatus 10 consists of a base 14 having associated operating components 16 capable of converting a liquid substance 18 into a vapor or fine mist (hereinafter "vapor"). A supply of the liquid substance 18 is maintained in a container 20, that is integrated into the base 14. The liquid substance 18 can be directed into the container 20 through an appropriate inlet 22. The liquid substance 18 in the container is delivered to the operating components 16 to be vaporized thereby so that vapor generated by the operating components 16 is directed through an outlet 24 into the space 12. Adornment 26 is provided to simulate the appearance of at least one of an animate or inanimate object.

The apparatus 10 is shown in schematic form in FIG. 1 to generically encompass virtually any type of apparatus capable of converting a liquid substance to a vapor for delivery into a space. While not so limited, an exemplary form of the apparatus 10, and others described hereinbelow, is a humidifier that converts water from liquid into a vapor state.

Figure 2:
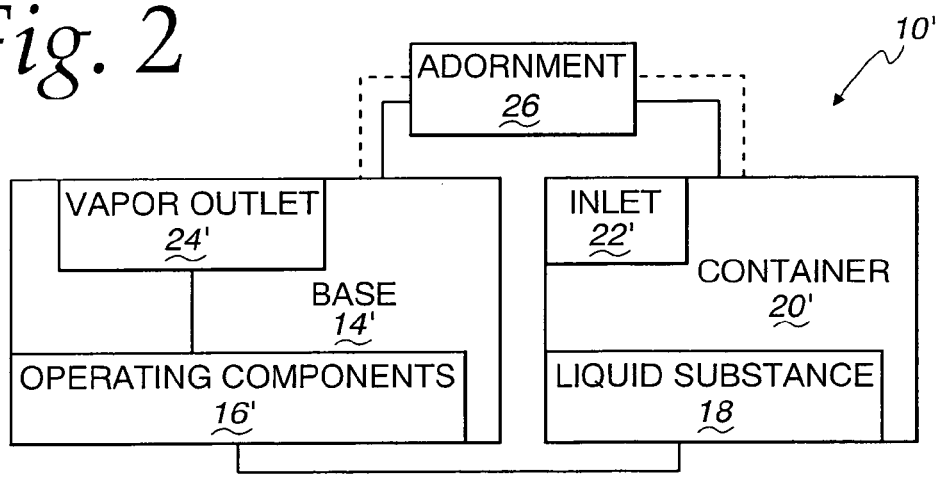
FIG. 2 is a schematic representation as in FIG. 1 of a modified form of apparatus wherein the container is separate from the base and vapor generated by the operating components is discharged to the surrounding space through the base.

In FIG. 2, a variation of the apparatus 10 is shown at 10', and differs from the apparatus 10 primarily by reason of the container 20' being a component that is separable from the base 14'. The base 14' has operating components 16' for converting the liquid substance 18 in the container 20' into vapor that is discharged at an outlet 24'. The liquid substance 18 can be supplied to the container 20' through an inlet 22'. The adornment 26 is shown to be provided on either or both of the base 14' and container 20'.

Figure 3:
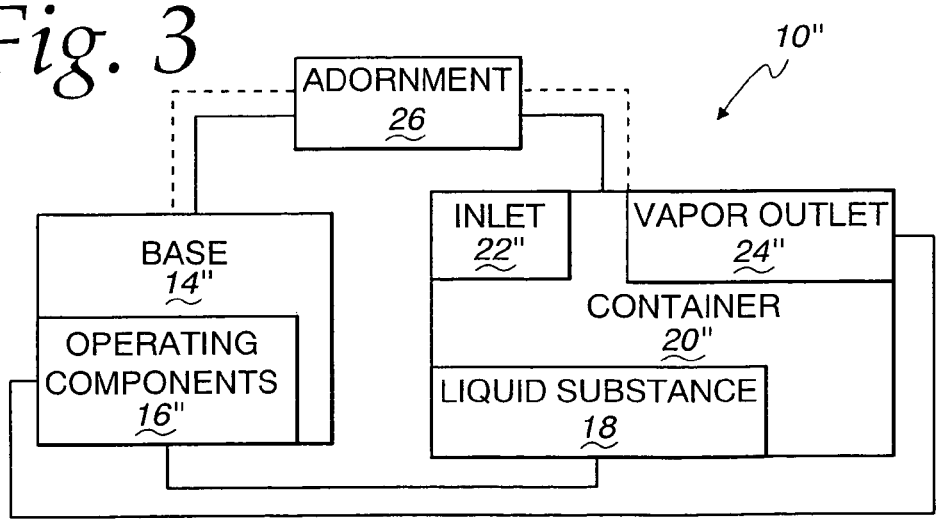
FIG. 3 is a schematic representation as in FIG. 2 of a modified form of apparatus wherein the vapor is delivered to the space through the container.

In FIG. 3, a further modified form of apparatus is shown at 10". The apparatus 10" differs from the apparatus 10' primarily by reason of the vapor outlet 24" being on the container 20". The apparatus 10" has a base 14" with operating components 16" that are capable of converting the liquid substance 18 in the container 20" into a vapor that is discharged at the outlet 24". The container 20" has an inlet 22" through which the supply of liquid substance 18 can be initially introduced and replenished. In this embodiment, the adornment 26 is likewise provided on either or both of the base 14" and container 20".

The three forms of apparatus 10, 10', 10" are representative of apparatus for directing a vaporized substance into a space that can be constructed and adorned according to the present invention. It should be understood that still other configurations of apparatus are contemplated by the invention.

Figure 4:
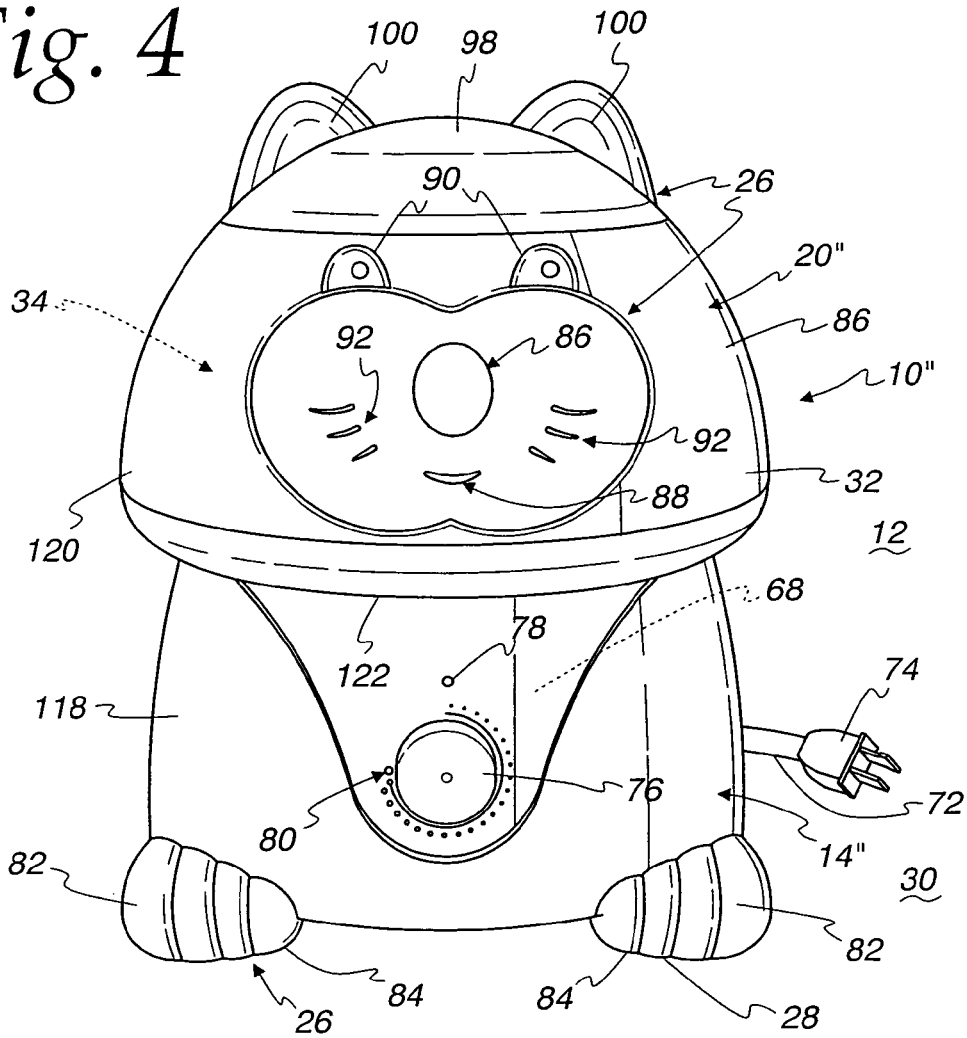
FIG. 4 is a front perspective view of one specific form of apparatus, as shown in FIG. 3, with adornment thereon simulating the appearance of a cat.
Figure 5:
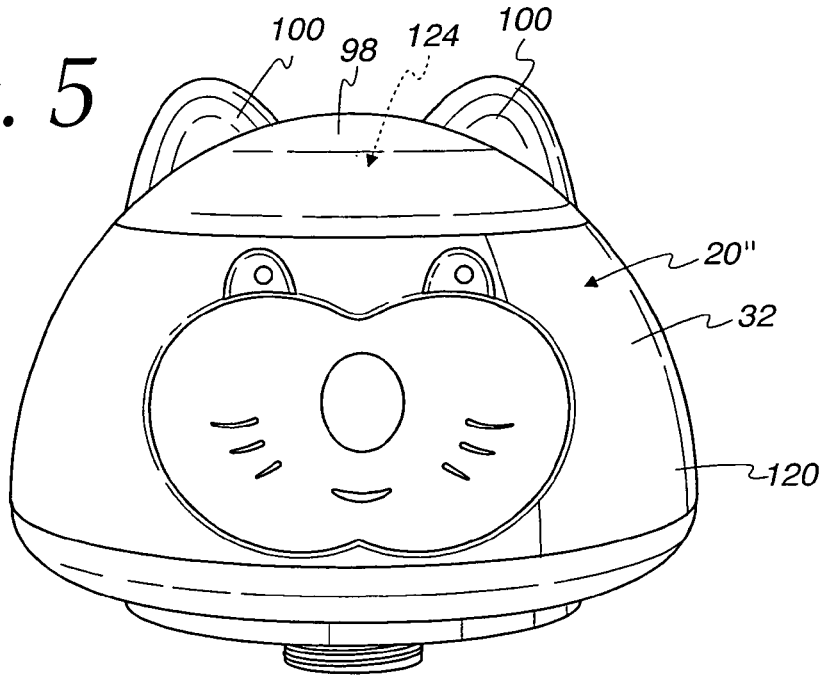
FIG. 5 is a front elevation view of the container in FIG. 4, with the container separated from the base.
Figure 6:
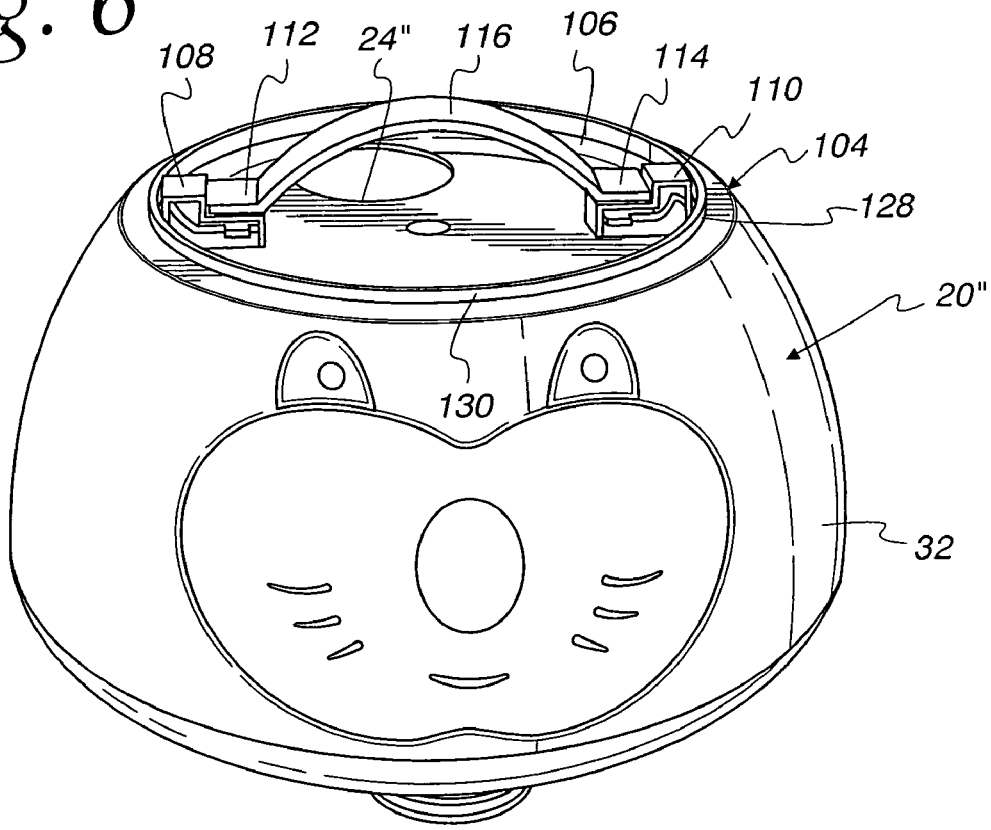
FIG. 6 is a view as in FIG. 5 wherein an adornment piece is separated from a main body on the container to expose a lifting handle.
Figure 7:
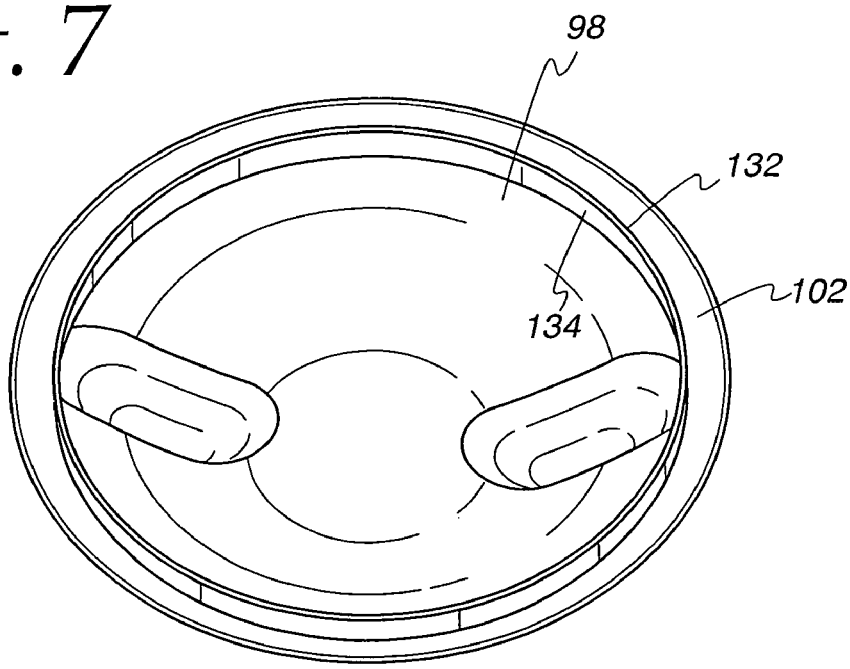
FIG. 7 is a bottom perspective view of the adornment piece shown on the apparatus in FIGS. 4 and 5.
Figure 8:
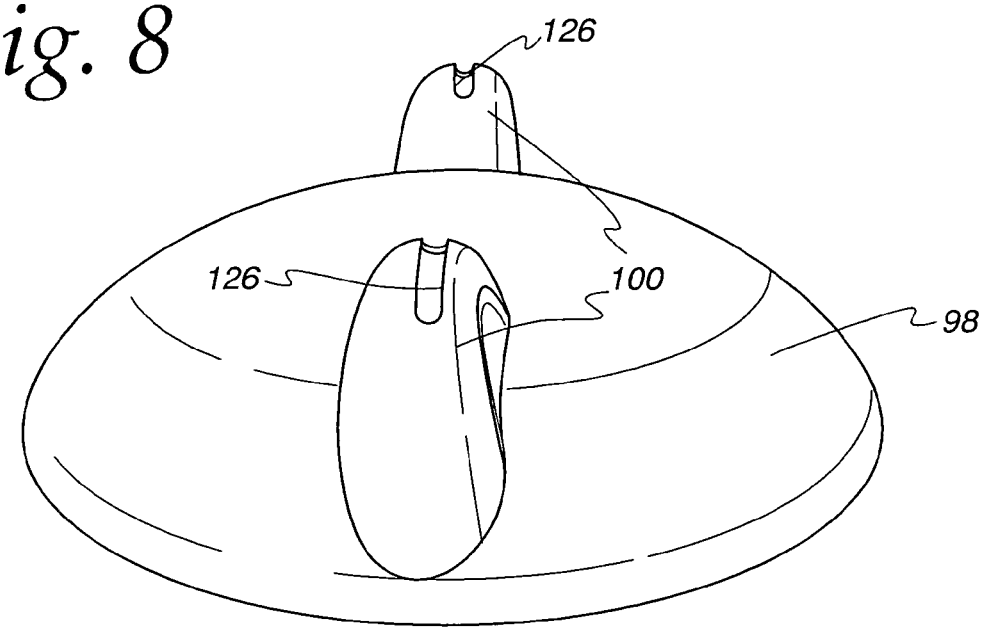
FIG. 8 is a side perspective view of the adornment piece in FIG. 7.
Figure 9:
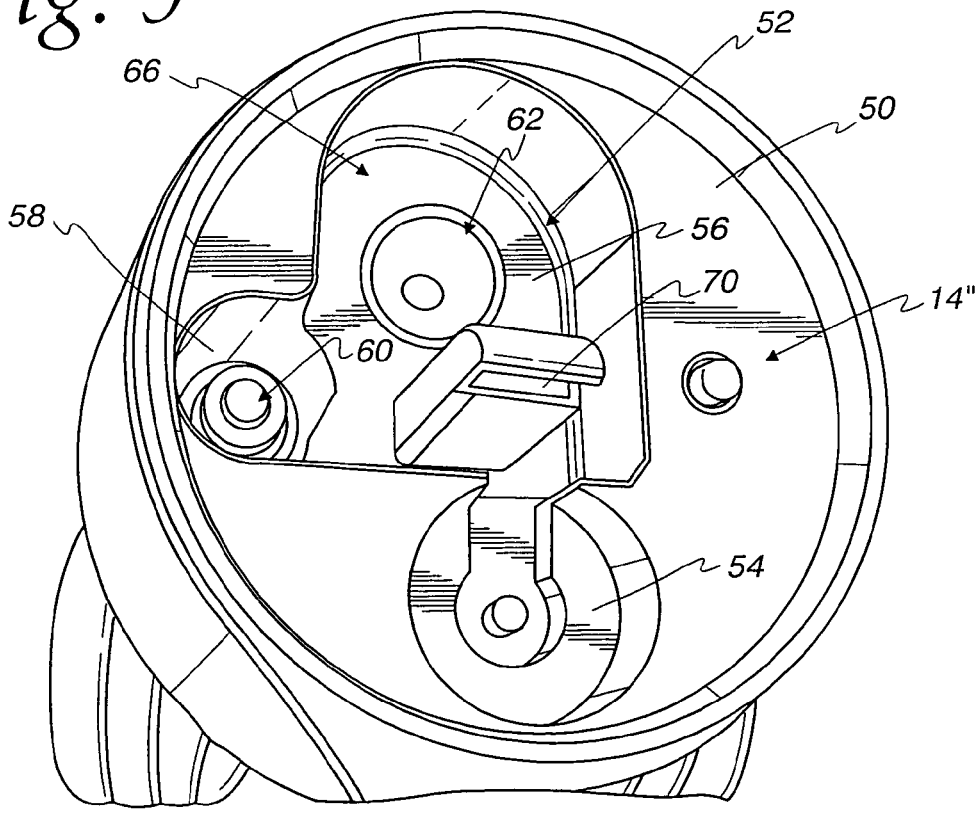
FIG. 9 is a top perspective view of the base on the apparatus in FIG. 4, with the container removed therefrom.
Figure 10:
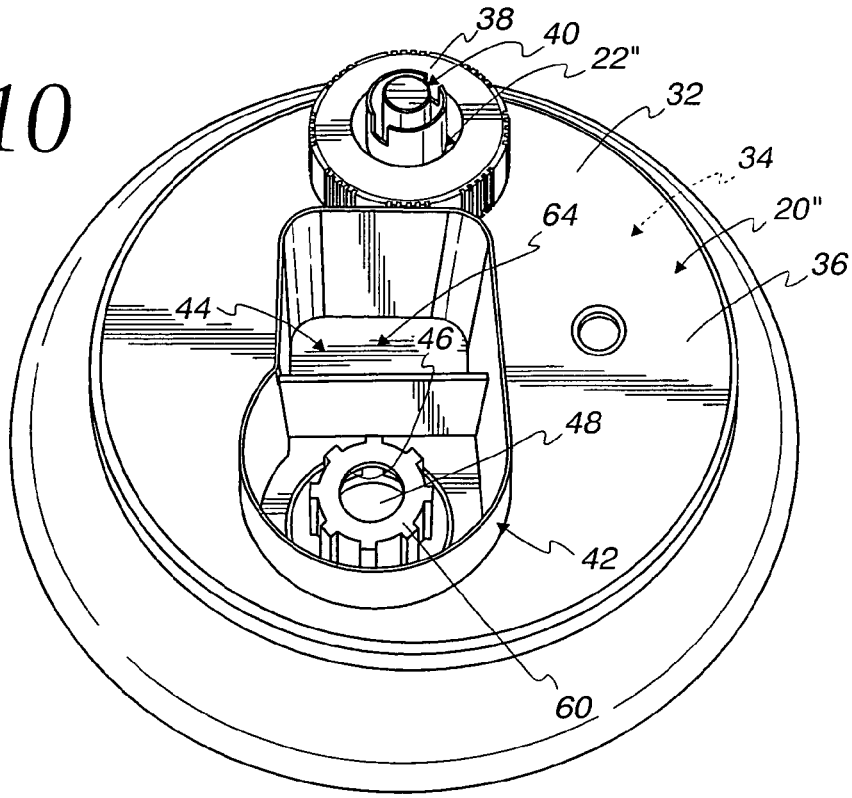
FIG. 10 is an underside perspective view of the container in FIGS. 4-6.

One more specific, exemplary form of the inventive apparatus 10", for directing a vaporized substance into the space 12, is shown in FIGS. 4-10. In this particular embodiment, the apparatus 10" is adorned to simulate the shape and appearance of a cat. The apparatus 10" consists of the base 14" and the container 20". The base 14" has a bottom 28 that can be placed upon a subjacent support surface 30. With the container 20" in an operative state, as shown in FIG. 4, the container 20" is situated on top of the base 14".

Briefly, the functional components of the humidifier are as follows. The container has a main body 32 that bounds a receptacle 34 for a supply of liquid substance 18. The inlet 22" is provided on the underside 36 of the main body 32 such that the container 20" is required to be inverted to facilitate introduction of the liquid substance 18 into the receptacle 34. The liquid substance 18 may be water, or any other vaporizable substance or mixture, that can be conveniently directed through the inlet 22" into the receptacle 34. The inlet 22" is blocked by a threadably connected cap 38. The cap 38 has an associated valve 40 through which the liquid substance 18 is controllably discharged from the receptacle 34.

A depending wall 42 extends continuously around a space 44 within which an inlet 46 to a vapor conduit 48 resides. The vapor conduit 48 communicates between the space 44 and the external space 12 through the receptacle 34. The vapor exhausts from the conduit 48 through the vapor outlet 24" at the top portion of the main body 32.

The base 14" has an upper region 50 at which an upwardly opening basin 52 is defined. The basin 52 has three distinct sub-chambers 54, 56, 58, in communication with each other.

With the container 20" in the operative state, the cap 38 and valve 40 nest in the sub-chamber 54. Liquid discharged into the sub-chamber 54 through the valve 40 flows gravitationally into the sub-chamber 58 in which a water level float 60 is situated. The water level float 60 controls the liquid level in the basin 52.

The liquid from the sub-chamber 54 also communicates gravitationally to a nebulizer 62 in the sub-chamber 56, which converts the liquid to a vapor within a substantially closed vaporization space. The vaporization space is bounded by a downwardly opening, cup-shaped surface 64, within the depending wall 42 on the container 20", and an upwardly opening, cup-shaped surface 66, bounding the sub-chamber 56, with the container 20" in the operative state of FIG. 4. Vapor from the vaporization chamber is communicated through the inlet 46, to and through the vapor conduit 48, and to and through the outlet 24" into the space 12.

The base 14" also supports a fan 68 which produces pressurized air at a vent 70 that is in communication with the vaporization chamber. The fan 68 may be designed to operate off of household current supplied using a conventional cord 72 and end plug 74.

The functional elements described hereinabove represent but one possible combination of the operating components 16" shown generically in FIG. 3. The invention contemplates virtually a limitless number of different types and arrangements of operating components to generate vapor. This particular embodiment should not be viewed as limiting.

Some additional, optional, features on the apparatus 10" include a settable knob 76, through which a humidity level can be selected. A light 78 gives the user a visual indication of the on/off state of the apparatus 10". A humidity output indicator light is provided at 80.

According to the invention, the adornment 26 is provided on the apparatus 10" to simulate, in this embodiment, the appearance of a cat over substantially the entire height of the apparatus 10". In this case, the adornment 26 is provided in three cooperating parts. The adornment consists of molded "feet/paws" 82 on the bottom of the base 14". The paws 82 have surfaces 84 that bear upon the support surface 30 to maintain the apparatus 10" in the operative orientation that is shown in FIG. 4.

At a mid-height location, the external surface 86 of the main body 32 is adorned to simulate the appearance of the face of the cat, including nose 86, mouth 88, eyes 90 and whiskers 92. These features may be painted on, molded integrally as part of the main body 32, or made as a separately applied component or components.

The third aspect of the adornment 26 consists of an adornment piece 98 that simulates the appearance at the top of the cat's head, including spaced ears 100. The adornment piece 98 has a generally cup-shaped underside surface 102 that conforms at least nominally to the shape of the upper region 104 of the main body 32, wherein the latter may nest in the former. The main body 32 is enlarged progressively downwardly over a vertical extent thereof directly below the adornment niece 98.

In this embodiment, the main body 32 is truncated to define a generally flat upper wall 106. The wall 106 has spaced bosses 108, 110 to which spaced ends 112, 114 of a U-shaped lifting handle 116 are respectively attached. By grasping the lifting handle 116, the user can conveniently elevate and reposition the container 20".

Once the container 20" has been filled, the user can, through the lift handle 116, reposition the container 20" to the operative state of FIG. 4. Thereafter, the adornment piece 98 can be placed upon the main body 32 to cover the lifting handle 116. In this particular embodiment, the adornment piece 98 fully covers the lifting handle 116. Once in place, the adornment piece 98 blends in with the remainder of the adornment so that substantially the entire height of the apparatus 10" is configured to simulate the appearance of a cat.

As seen in FIG. 4, the exposed, circumferential surface 118 of the base 14" has an effective diameter that is less than the effective diameter of the exposed, circumferential surface 120 of the container 20" above a juncture line 122. By reason of this difference in diameter, and by reason of the curved tapering of the surface 120 from the mid-height portion towards the top thereof, the container 20", including the adornment piece 98, gives the appearance of a discrete head upon a torso, with the latter simulated by the base 14" that is located directly below the head and has thereon the associated "paws"/feet 82.

Between the surface 102 on the adornment piece 98 and the upper wall 106 on the main body 32, a sub-vaporization chamber 124 is defined that is in communication with the outlet 24". Elongate openings 126 are provided, one each, at the top of the ears 100, to communicate the vapor directly to the space 12 from the sub-vaporization chamber 124. This gives a unique visual effect; that being that the vapor is emanating from the cat's ears.

To facilitate consist placement of the adornment piece 98, the wall 106 is provided with an upwardly projecting rim 128 with an outside, annular surface 130. The adornment piece 98 has a depending rim 132 with an inside, annular surface 134 that relatively closely surrounds the rim surface 130.

By grasping the adornment piece 98, as by the ears 100, the adornment piece 98 can be separated from the main body 32, from the FIG. 4 position, to expose the lifting handle 116 for use. The adornment piece 98 can be replaced upon the main body 32 preparatory to operating the apparatus 10".

Figure 11:
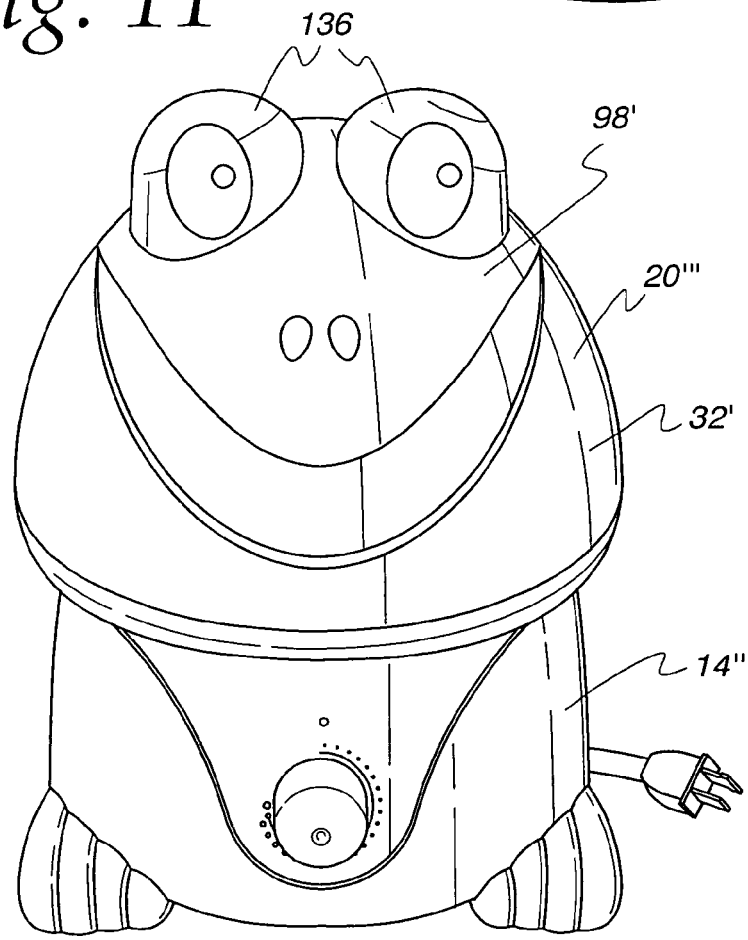
FIG. 11 is a view as in FIG. 4 of a modified form of apparatus with adornment thereon simulating the appearance of a frog.
Figure 12:
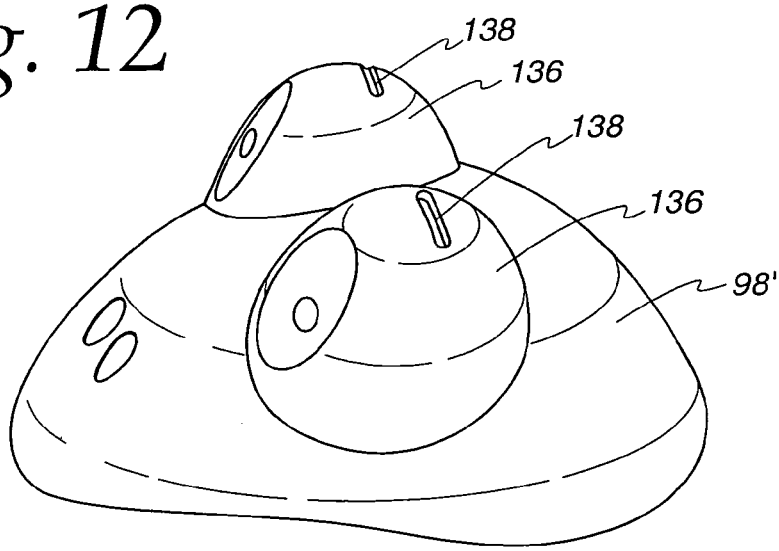
FIG. 12 is a side perspective view of an adornment piece that is separated from the apparatus in FIG. 11.

It is possible, according to the present invention, to use a generic base and main body construction to produce the appearance of a combined head and torso and to use different adornment pieces to simulate the appearance of different human or non-human beings. For example, as shown in FIGS. 11 and 12, the base 14" can be used in conjunction with a container 20'", having substantially the same shape as the container 20", but lacking the adornment on the exposed surface thereof, simulating the face of a cat. This generic base and container combination can be used to support different adornment pieces to simulate the appearance of different "beings".

As shown in FIGS. 11 and 12, an adornment piece 98' is shown upon the main body 32' of the container 20'" and configured to simulate in shape and appearance a part of the head of a frog on the base 14". The adornment piece 98' cooperates with the main body 32' in substantially the same manner as the adornment piece 98 cooperates with the main body 32 in the embodiment shown in FIGS. 4-10. In FIGS. 11 and 12, the adornment piece 98 ' has raised elements 136 to simulate the appearance of frog eyes. Elongate openings 138 are provided, one each, on top of the eyes. Vapor generated by the operating components is discharged through the openings 138 so that it appears that vapor is emanating from the eyes, or the top of the head, of the frog.

Figure 13:
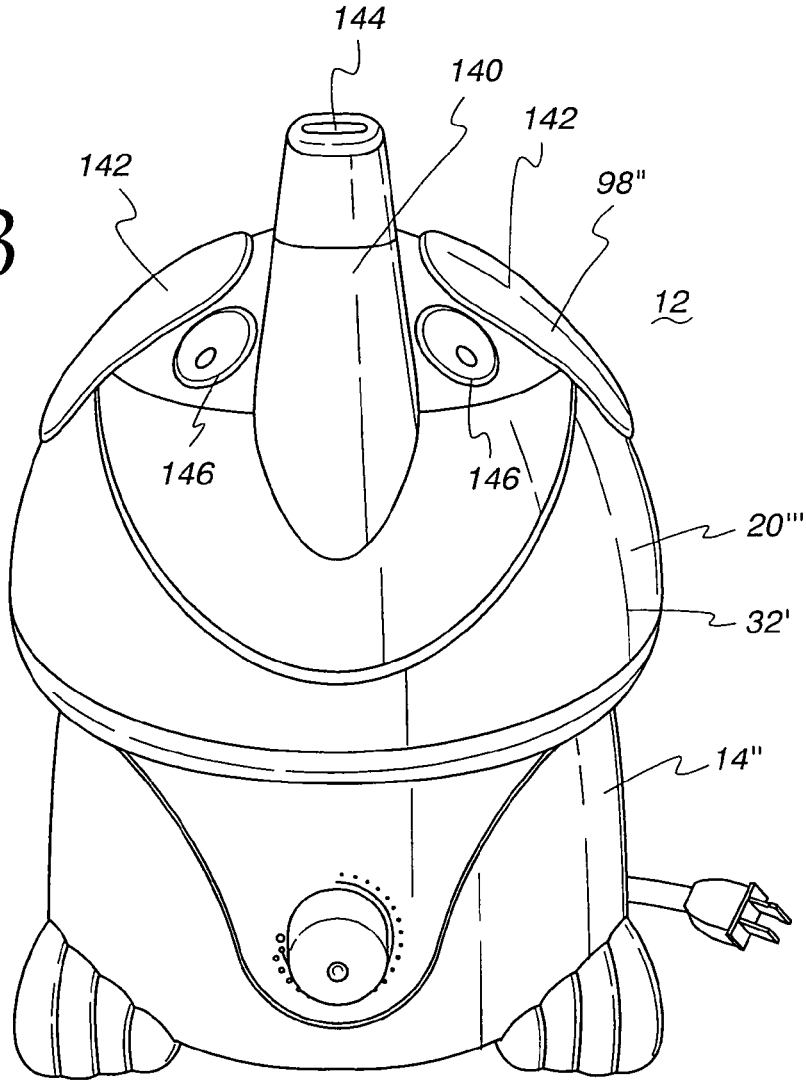
FIG. 13 is a view as in FIGS. 4 and 11 of a modified form of apparatus, according to the present invention, with adornment thereon simulating the appearance of an elephant.
Figure 14:
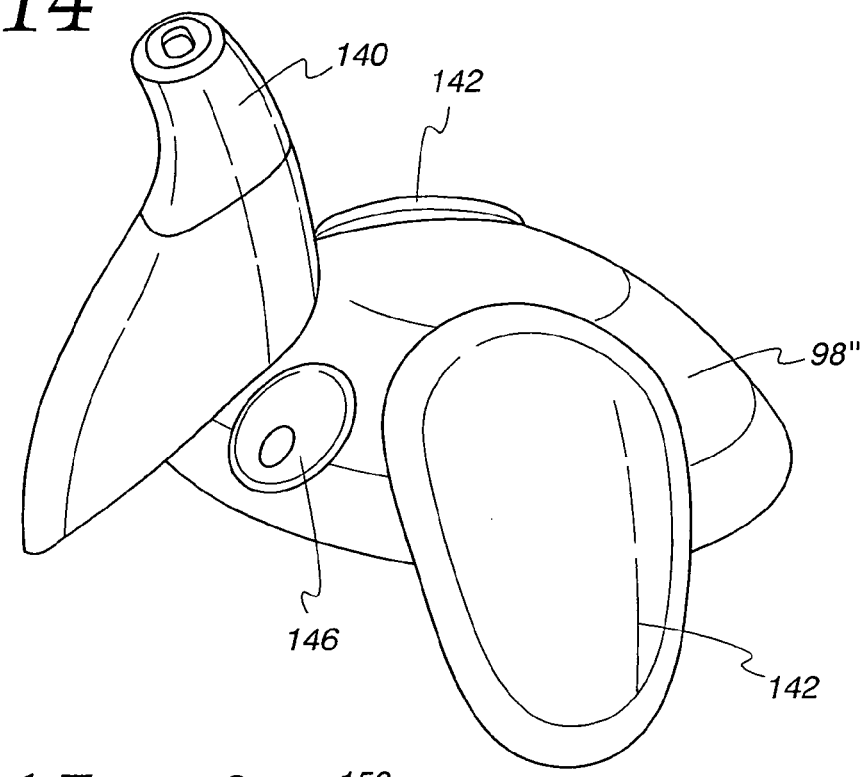
FIG. 14 is a side perspective view of an adornment piece that is separated from the apparatus in FIG. 13.

As shown in FIGS. 13 and 14, an adornment piece 98" is placed upon the generic base 14" and main body 32' combination to produce a simulation of the shape and appearance of an elephant, including a head and torso. The adornment piece 98" is configured to cooperate with the main body 32' of the container 20'" to be selectively placed thereupon and separated therefrom, as to expose a lifting handle (not shown) or other functional or non-functional component(s). The adornment piece 98" has a projection 140 to simulate the trunk of an elephant and flaps 142 to simulate an elephant's ears. The projection 140 has an elongate top opening 144 to communicate vapor generated by the operating components to the space 12, thereby giving the appearance that the vapor is emanating from the elephant's "trunk". Contrasting, rounded shapes 146 give the appearance of "eyes".

Figure 15:
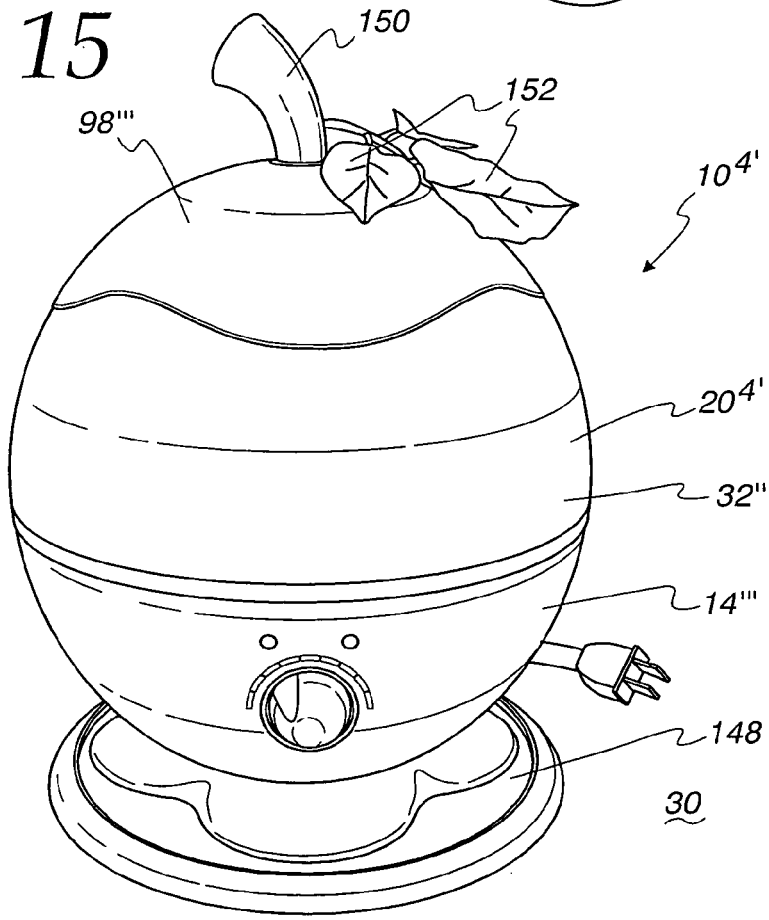
FIG. 15 is a front perspective view of further modified form of apparatus, according to the present invention, with adornment thereon simulating the appearance of a piece of fruit.

While the use of a generic base and main body combination affords manufacturing flexibility, the invention contemplates that the base and main body/container could take virtually a limitless number of different forms, each of which may be customized to a different object. In FIG. 15, an apparatus is shown at $10^{4'}$ in the form of a piece of fruit. The base 14'" has the shape of the bottom of the piece of fruit and an enlarged, disc-shaped element 148 to bear upon the subjacent support surface 30 and maintain the base 14'" in the operative orientation.

The container $20^{4'}$ is matched to the base 14'" to simulate the shape and appearance of the upper region of the piece of fruit. An adornment piece 98'" is attached, as in the prior embodiments, and has a simulated stem 150 and leaves 152. While the main body 32" and base 14'" are designed specifically to simulate fruit, the aforementioned generic base and main body combination could be used and adorned to simulate the appearance of a piece of fruit.

Figure 16:
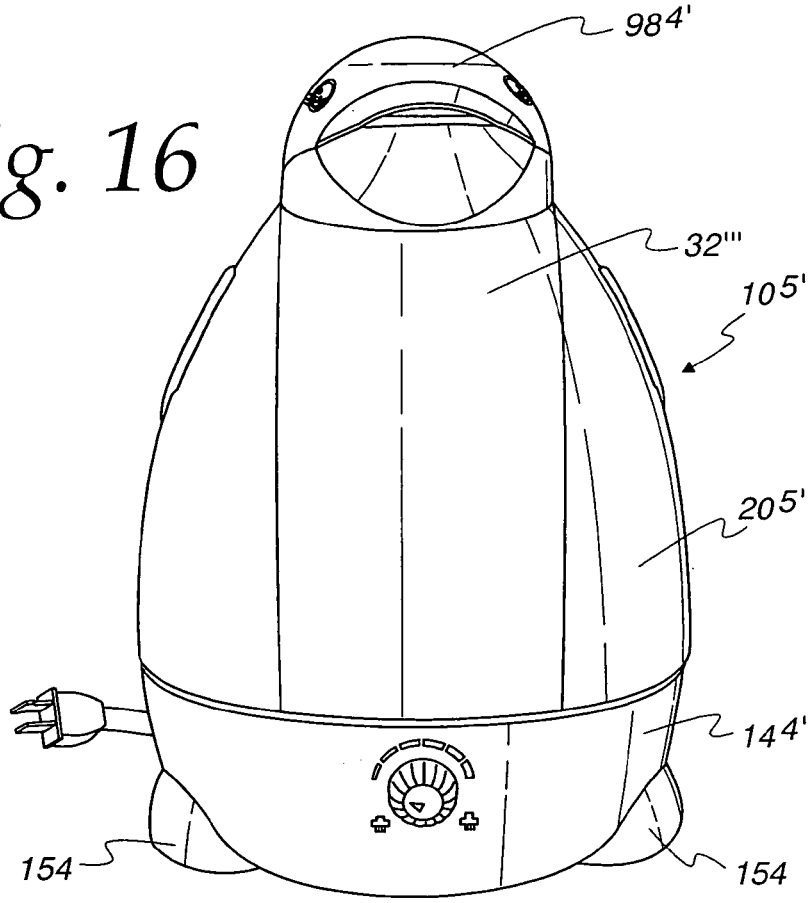
FIG. 16 is a front perspective view of a still further modified form of apparatus, according to the present invention, with adornment thereon simulating the appearance of a penguin.
Figure 17:
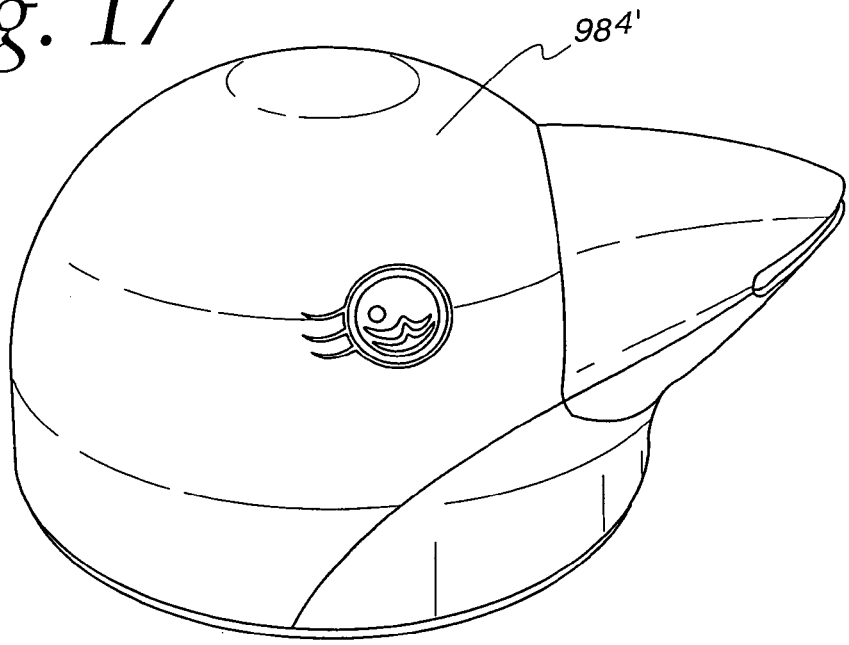
FIG. 17 is an enlarged, side, perspective view of an adornment piece simulating the appearance of the head of the penguin in FIG. 16 and separated from the remainder of the apparatus.

In FIGS. 16-17, a further modified form of apparatus is shown at $10^{5'}$, wherein a base $14^{4'}$ with "feet/flippers" 154 thereon, is joined with a container 20$^{5'}$ so that the base 14$^{4'}$ and container 20$^{5'}$ cooperatively produce the shape and appearance of the torso of a penguin. In this embodiment, an adornment piece 98$^{4'}$ is separately attached to the main body 32''' and configured to simulate the shape and appearance of a penguin's head.

Figure 18:
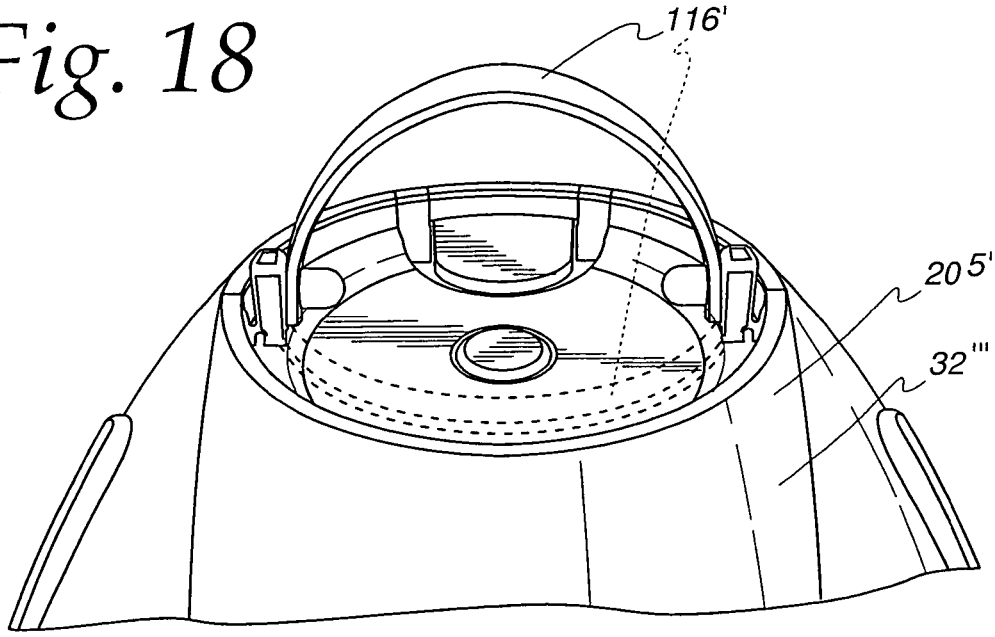
FIG. 18 is a fragmentary, front, perspective view of the top of the container on the apparatus in FIG. 16 with the adornment piece removed and with a lifting handle repositioned to be grasped by a user.

In this embodiment, a lifting handle 116' is repositionable relative to the main body 32''' between the solid line position and dotted line position in FIG. 18. In the raised, solid line position for the lifting handle 116', the lifting handle 116' is more readily accessible for grasping. In the dotted line position, the lifting handle 116' is stored so that is can be covered by a lower profile shape for the adornment piece 98$^{4'}$.

Figure 19:
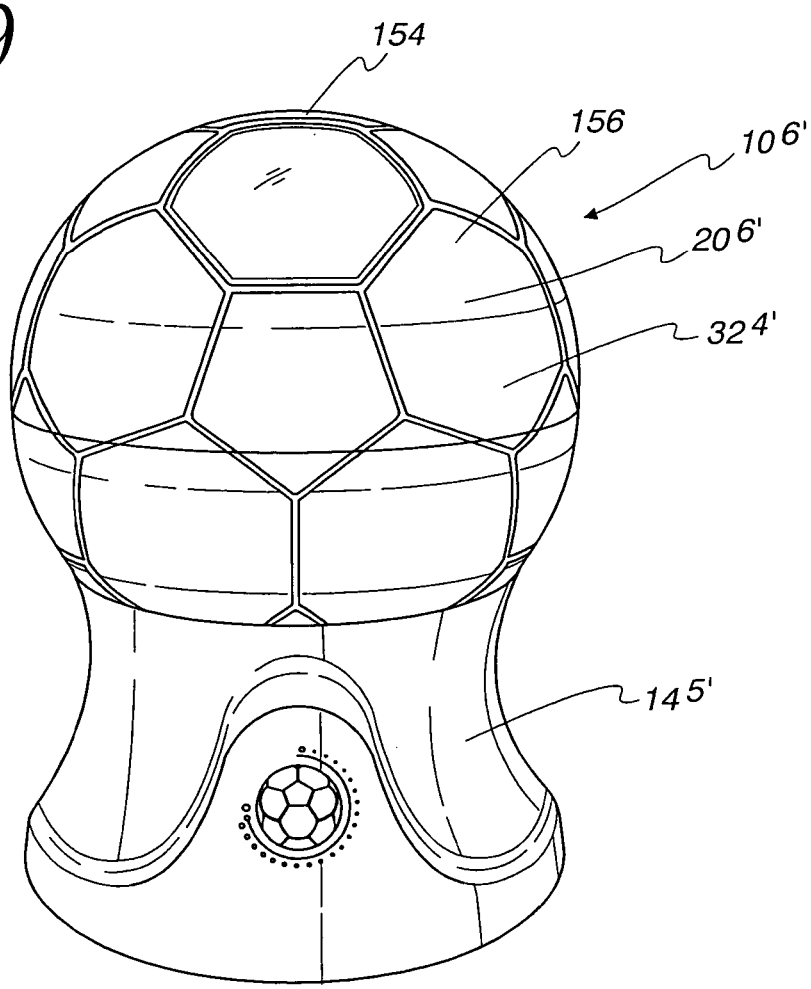
FIG. 19 is a front perspective view of a still further modified form of apparatus, according to the present invention, with adornment thereon simulating the appearance of a soccer ball on a stand.
Figure 20:
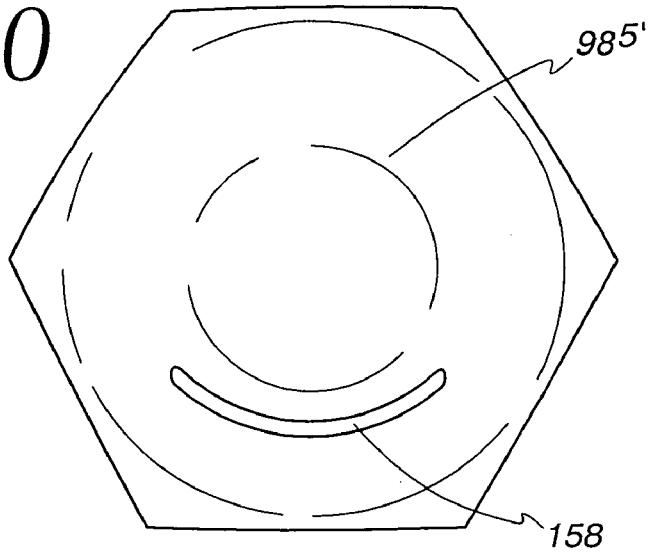
FIG. 20 is an enlarged, plan view of an adornment piece that is separated from the remainder of the apparatus in FIG. 19.

An apparatus 10$^{6'}$ is shown in FIGS. 19 and 20, to include a base 14$^{5'}$ configured as a stand for a container 20$^{6'}$ that simulates the shape and appearance of a soccer ball. As seen in FIG. 20, an adornment piece 98$^{5'}$ simulates one of the ball panels and is selectively placed into a complementary receptacle 154 and removed therefrom. The installed adornment piece 98$^{5'}$ is flush with the exposed surface 156 of the main body 32$^{4'}$. The adornment piece 98$^{5'}$ has a U-shaped opening 158 through which vapor generated by operating components on the base 14$^{5'}$ is discharged.

As noted previously, the invention contemplates that the adornment may simulate any animate or inanimate object. The adornment may be on one or both of the base and container. The objects noted above are but exemplary in nature.

Figure 21:
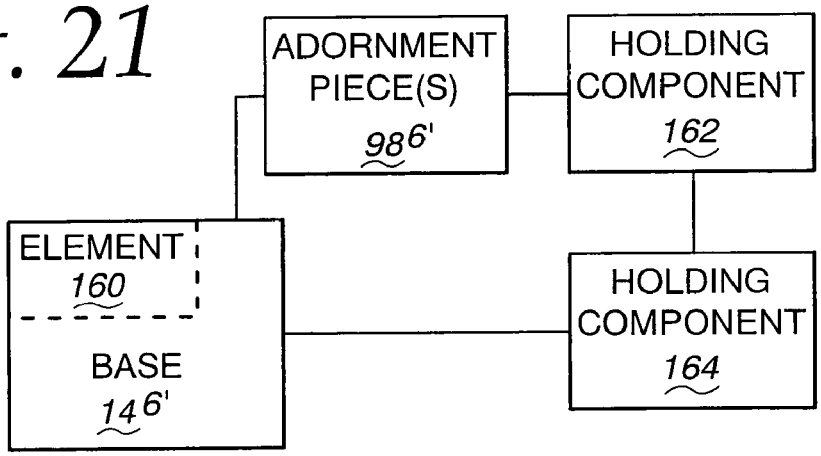
FIG. 21 is a schematic representation of a base on an apparatus having one or more adornment pieces thereon and maintained on the base through cooperating holding components on the adornment piece and base.

As shown in FIG. 21, the invention contemplates that one or more adornment pieces 98$^{6'}$ may be provided strategically at one or more locations with respect to a base 14$^{6'}$. The adornment piece(s) 98$^{6'}$ may cover any part of the base 14$^{6'}$, including potentially any functional element 160 thereon which is desirably covered in use.

In the embodiments described above, facing annular surfaces perform the function of holding components for the adornment pieces. The invention contemplates many different configurations for holding components shown generically at 162, 164 on adornment pieces 98$^{6'}$ and the base 14$^{6'}$, respectively. These holding components 162, 164 may facilitate snap fit connection, or other releasable connection of a type well known to those skilled in the art.

Figure 22:
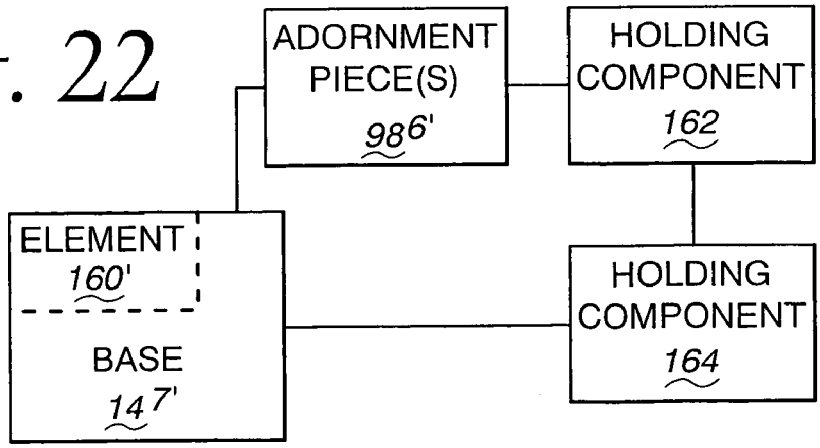
FIG. 22 is a schematic representation as in FIG. 21 wherein the adornment piece(s) is/are releasably maintained by cooperating holding components upon a main body.

As shown in FIG. 22, the adornment pieces 98$^{6'}$ may be strategically attached to the base 14$^{7'}$ potentially to cover an element 160. The adornment pieces 98$^{6'}$ and main body 14$^{7'}$ are held together through cooperating holding components 162, 164, as previously described, thereby to facilitate removable connection of the adornment pieces 98$^{6'}$ to the main body 14$^{7'}$.

The foregoing disclosure of specific embodiments is intended to be illustrative of the broad concepts comprehended by the invention.

The invention claimed is:

1. An apparatus for directing a vaporized substance into a space, the apparatus comprising:

a base, the base having operating components capable of converting a liquid substance into a vapor; and a substance supply container that is separable from the base, the substance supply container in an operative state in relationship to the base delivering a supply of a substance therein in liquid form to the operating components on the base to be vaporized thereby so that vapor generated by the operating components is directed into a space within which the apparatus is located, wherein the base and substance supply container each has a shape and adornment thereon that are at all times exposed and simulate the shape and appearance of a part of at least one of an identifiable animate or inanimate object.

2. The apparatus for directing a vaporized substance into a space according to claim 1 wherein the base and substance supply container have a shape and adornment thereon that simulate the shape and appearance of at least a part of an identifiable animate object, the substance supply container has a main body with a U-shaped lifting handle that can be grasped by a user to lift the substance supply container and the substance supply container comprises an adornment piece that can be placed upon the main body to at least partially cover the lifting handle, the adornment piece simulating the shape and appearance of a part of the animate object.

3. The apparatus for directing a vaporized substance into a space according to claim 2 wherein the adornment piece has an inverted cup shape that conforms to a part of the main body, the main body enlarged progressively downwardly over a vertical extent of the main body directly below the adornment piece.

4. The apparatus for directing a vaporized substance into a space according to claim 3 wherein the adornment piece has an opening through which vapor generated by the operating components is controllably directed.

5. The apparatus for directing a vaporized substance into a space according to claim 1 wherein the base simulates the shape and appearance of substantially the entirety of a torso of a living being directly below the head of the living being and the base has a bottom upon which visible adornment is provided that simulates the shape and appearance of feet of the living being and the substance supply container has adornment thereon that simulates the head of the living being.

6. The apparatus for directing a vaporized substance into a space according to claim 5 wherein the substance supply container has a main body that is shaped to simulate a part of a head of a living being and an adornment piece that can be placed removably upon the main body, the adornment piece simulating the appearance of only a part of the head of the living being.

7. The apparatus for directing a vaporized substance into a space according to claim 6 wherein the adornment piece has an opening through which vapor generated by the operating components is controllably directed to thereby give the appearance that vapor is emanating from the simulated head of the living being.

8. The apparatus for directing a vaporized substance into a space according to claim 6 wherein the substance supply container has a U-shaped lifting handle that can be grasped by a user to lift the substance supply container and the adornment piece can be selectively: a) separated from the main body to expose the lifting handle; and b) placed upon the main body to at least partially cover and block the lifting handle from view.

9. The apparatus for directing a vaporized substance into a space according to claim 1 wherein the base and substance supply container cooperatively simulate the shape and appearance of a living being with a head, a torso, and feet, the substance supply container simulating substantially the entirety of the head of the living being.

10. The apparatus for directing a vaporized substance into a space according to claim 9 wherein the base simulates shapes of the torso and the feet of the living being.

11. The apparatus for directing a vaporized substance into a space according to claim 10 wherein the apparatus has a top and bottom, the base defines the bottom of the apparatus upon which the apparatus can be supported on a subjacent surface and the bottom of the apparatus is configured so that the apparatus appears to be supported on a subjacent surface by the simulated feet.

12. An apparatus for directing a vaporized substance into a space, the apparatus comprising:

a base, the base having operating components capable of converting a liquid substance into a vapor; and a substance supply container that is separable from the base, the substance supply container in an operative state in relationship to the base delivering a supply of a substance therein in liquid form to the operating components on the base to be vaporized thereby so that vapor generated by the operating components is directed into a space within which the apparatus is located, wherein the base has a bottom that can be placed upon a support surface and with the container in the operative state the substance supply container is situated on top of the base, wherein the apparatus has a height and a majority of the height of the apparatus is shaped and adorned to simulate the shape and appearance of an identifiable living being with a head, the vapor generated by the operating components controllably directed to thereby give the appearance that vapor is emanating from the simulated head.

13. The apparatus for directing a vaporized substance into a space according to claim 12 wherein there is adornment on each of the base and substance supply container that simulates the shape and appearance of the living being.

14. The apparatus for directing a vaporized substance into a space according to claim 12 wherein the substance supply container has a main body with a U-shaped lifting handle that can be grasped by a user to lift the substance supply container and the substance supply container comprises an adornment piece that can be placed upon the main body to at least partially cover the lifting handle, the adornment piece simulating the appearance of a part of the living being.

15. The apparatus for directing a vaporized substance into a space according to claim 14 wherein the adornment piece has an inverted cup shape that conforms to a part of the main body.

16. The apparatus for directing a vaporized substance into a space according to claim 15 wherein the adornment piece has an opening through which vapor generated by the operating components is controllably directed.

17. The apparatus for directing a vaporized substance into a space according to claim 12 wherein adornment is provided on the bottom of the base that simulates the shape and appearance of feet of the living being and the substance supply container has adornment thereon that simulates the head of the living being.

18. The apparatus for directing a vaporized substance into a space according to claim 17 wherein the substance supply container has a main body and an adornment piece that can be placed removably upon the main body, the adornment piece simulating the appearance of at least a part of the head of the living being.

19. The apparatus for directing a vaporized substance into a space according to claim 18 wherein the adornment piece simulates the shape and appearance of at least a part of the head of the living being with at least one of a nose, eyes and ears and the adornment piece has an opening through which vapor generated by the operating components is controllably directed to thereby give the appearance that vapor is emanating from at least one of the simulated nose, eyes or ears of the living being.

20. The apparatus for directing a vaporized substance into a space according to claim 18 wherein the substance supply container has a U-shaped lifting handle that can be grasped by a user to lift the substance supply container and the adornment piece can be selectively: a) separated from the main body to expose the lifting handle; and b) placed upon the main body to at least partially cover the lifting handle.

21. An apparatus for directing a vaporized substance into a space, the apparatus comprising:

a base, the base having operating components capable of converting a liquid substance into a vapor; and a substance supply container that is separable from the base, the substance supply container in an operative state in relationship to the base delivering a supply of a substance therein in liquid form to the operating components on the base to be vaporized thereby so that vapor generated by the operating components is directed into a space within which the apparatus is located, wherein at least a part of the apparatus is adorned to simulate the shape and appearance of at least one of an animate and inanimate object, wherein the substance supply container has a main body with a U-shaped lifting handle that can be grasped by a user to lift the substance supply container, wherein the substance supply container comprises an adornment piece that can be placed upon the main body to at least partially cover the lifting handle, the adornment piece simulating the shape and appearance of a part of the at least one of an identifiable animate and inanimate object.

22. The apparatus for directing a vaporized substance into a space according to claim 21 wherein the base has a bottom that can be placed upon a support surface, with the substance supply container in the operative state the substance supply container is situated on top of the base, the apparatus has a height, and substantially the entirety of the height of the apparatus is shaped and adorned to simulate the shape and appearance an identifiable animate object.

23. The apparatus for directing a vaporized substance into a space according to claim 21 wherein the adornment piece has an inverted cup shape that conforms to a part of the main body.

24. The apparatus for directing a vaporized substance into a space according to claim 23 wherein the adornment piece has an opening through which vapor generated by the operating components is controllably directed.

25. The apparatus for directing a vaporized substance into a space according to claim 21 wherein the base has a bottom upon which adornment is provided that simulates the shape and appearance of feet of a living being and the substance supply container has adornment thereon that simulates the shape and appearance of the head of the living being.

26. The apparatus for directing a vaporized substance into a space according to claim 25 wherein the substance supply container has a main body and an adornment piece that can be placed removably upon the main body, the adornment piece simulating the shape and appearance of at least a part of the head of the living being.

27. The apparatus for directing a vaporized substance into a space according to claim 26 wherein the adornment piece has an opening through which vapor generated by the operating components is controllably directed to thereby give the appearance that vapor is emanating from the simulated head of the living being.

28. The apparatus for directing a vaporized substance into a space according to claim 26 wherein the substance supply container has a lifting handle that can be engaged by a user to lift the substance supply container and the adornment piece can be selectively: a) separated from the main body to expose the lifting handle; and b) placed upon the main body to at least partially cover and block the lifting handle from view.

29. An apparatus for directing a vaporized substance into a space, the apparatus comprising:

a base, the base having operating components capable of converting a liquid substance into a vapor; and a substance supply container, the substance supply container in an operative state in relationship to the base delivering a supply of a substance therein in liquid form to the operating components on the base to be vaporized thereby so that vapor generated by the operating components is directed into a space within which the apparatus is located, wherein at least part of the apparatus is adorned to simulate the shape and appearance of at least one of an animate and inanimate object, wherein the substance supply container comprises an adornment piece that simulates the shape and appearance of at least a part of the animate or inanimate object and a main body, the adornment piece capable of being selectively placed upon and separated from the main body, each of the base and main body simulating in shape and appearance another part of the animate or inanimate object.

30. The apparatus for directing a vaporized substance into a space according to claim 29 wherein the base has a bottom that can be placed upon a support surface, with the substance supply container in the operative state the substance supply container is situated on top of the base, the apparatus has a height, and substantially the entirety of the height of the apparatus is shaped and adorned to simulate the appearance of a living being.

31. The apparatus for directing a vaporized substance into a space according to claim 29 wherein the apparatus further comprises a U-shaped lifting handle and the adornment piece can be selectively: a) separated from the main body to expose the lifting handle; and b) placed upon the main body to at least partially cover and block the lifting handle from view.

32. The apparatus for directing a vaporized substance into a space according to claim 29 wherein the apparatus is adorned to simulate the appearance of a living being with a head and the adornment piece simulates the shape and appearance of only a part of the head of the living being.

* * * * *